US005833393A

United States Patent [19]

Carnahan et al.

[11] Patent Number: 5,833,393

[45] Date of Patent: Nov. 10, 1998

[54] WAVE CANNON

[76] Inventors: Richard P. Carnahan, P.O. Box 7281, Virginia Beach, Va. 23458; Troy W. Kight, P.O. Box 7281, Virginia Beach, Va. 23451

[21] Appl. No.: 376,343

[22] Filed: Mar. 30, 1995

[51] Int. Cl.[6] ..... E04H 3/18

[52] U.S. Cl. ..... 405/79; 4/491

[58] Field of Search ..... 405/52, 76, 79; 4/491

[56] References Cited

U.S. PATENT DOCUMENTS

| | | | |
|---|---|---|---|
| 4,522,535 | 6/1985 | Bastenhof | 405/79 |
| 4,539,719 | 9/1985 | Schuster | 4/491 |
| 4,558,474 | 12/1985 | Bastenhof | 4/491 |
| 4,730,355 | 3/1988 | Kreinbihl | 4/491 |
| 5,098,222 | 3/1992 | Robinson | 405/79 |

FOREIGN PATENT DOCUMENTS

| | | | |
|---|---|---|---|
| 2693225 | 1/1994 | France | 405/79 |
| 9105170 | 4/1991 | WIPO | 405/79 |

*Primary Examiner*—William P. Neuder
*Attorney, Agent, or Firm*—Christie, Parker & Hale, LLP

[57] ABSTRACT

A wave forming generator which can repeatedly produce and launch singular waves across the surface of a body of water. The wave generator includes an air compressor interconnected with are a large air pressure holding tank. A hydraulic actuated valve is fitted onto the air pressure tank. Piping is then connected to the valve and ran out and down to join and connect to several main water tubes, cannons, pipes, or anything that can take the form of a long round elongated chamber. The elongated chambers are submerged just under the surface of the water, being anchored on an angle with the opened ends of the water chambers pointing upwardly. The opened ends of the elongated chambers face towards the artificial reef, shoreline, or the opposite end of the pool. To generate waves the control valve herein is opened and closed in short intervals and sequences which create sets of waves by allowing bursts of pressurized air from the air tank to be released into the water chambers forcing the water out the opened ends of the water chambers and into the body of water in a single forceful motion. The air then escapes out the opened ends of the water chambers following the water it just shot out therefore water rapidly refills back into the water chambers inbetween the actuation of the valve, preparing the water chambers for another wave formation sequence. This sequence is rapidly repeated to produce an ocean movement simulation.

20 Claims, 13 Drawing Sheets

1
2
5
6
7
9
10
17
18
19
20
21
22
23
24
25
26
30

WAVE CANNON

FIELD OF THE INVENTION

The present invention is related to wave generators for forming fluid waves of any size and more particularly, to a wave generator which can be placed into or connected within a body of water to give the water wave motion.

BACKGROUND OF THE INVENTION

Waves, and the ocean attract billions of enthusiasts of all ages to their coastlines each year. With the main industry from this migration being based upon the unpredictable weather systems to create ocean movements (waves). So inventors have been designing devices to simulate this motion in swimming pools thus creating wave pools. Such devices were designed mainly and sometimes only for the application of a wave pool. Building costs for a deep water pool run about $80.00 per square foot. To make a eight foot wave, you need at least a 20,000 square foot pool. That adds up to be 1.6 million dollars for the pool alone. Also all that water needs to be kept clean, and that means spending money on filtration and chlorination.

Despite these financial obstacles these devices were manufactured. Unlike the present invention herein where as it was designed not only with a wave pool application but also the ability to create wave motion in any form of water. Leaving the possibility for the ability for a multitude of places the present invention could be built and operated at to create wave motion. Because of this other application of the present invention it leaves the ability for the wave cannon to help against the ongoing fight of beach erosion, by the use of a page 2 large artificial wave to calm or even cancel out smaller natural waves. Said waves being located in a large body of water like a ocean, bay, sound, or a large lake therefor the wave cannon acts like a bulkhead by deflecting incoming waves that pound their shorelines.

U.S. Pat. Nos. 4,467,483 and 4,558,474, both issued to D. Bastenhof, disclose a pneumatic wave generator for a surf pool. The disclosed wave generator includes a separate valve arrangement for each wave generating chamber for moving air from a source of forced air into the wave generating chambers. With each chamber having a volume of air or pocket of air in said chambers at all time during the operation labeled as the pressure chamber. The chambers have a two valve arrangement by having an inlet valve and an outlet valve with a common drive there between, so that whenever the inlet valve is closed the outlet valve is open and vise versa. The chambers are placed so that a portion of the chambers are above the surface of the pool water level.

Another form of pneumatic wave generator known is illustrated in the Kreinbihl et al, U.S. Pat No. 4,730,355. This wave generator included a four way air directional valve assembly for the use in a wave pool. Having a plurality of wave generating chambers arranged vertically attached side by side and extending across the width of a pool at one end thereof. The valve assembly can direct air into both chambers simultaneously or direct air into one chamber while exhausting the other chamber or exhausting both chambers while blocking air from the source of forced air. The forced air enters the top back of said chambers and the water exits out the bottom side.

Having air in said chambers at all times during operation. The comparison of the Bastenhof patents and Kreinbihl et al, patent. They are both a pneumatic wave generator for generating wave motion specifically in swimming pools or wave pools. They compare by the vertically connected water chambers that are slightly above the water surface, containing a pocket of air in said chambers. Being pressurized from the top of the chambers and the water is being forced out the bottom side opening of the chambers. They have a complexity of valves to blast air into the chambers and valves to exhaust air out of the chambers allowing the chambers to refill with water.

The Robinson U.S. Pat, No. 5,098,222 this wave generator and also Schuster et al U.S. Pat, No. 4,539,719. Include water chambers that are mainly above the water surface. By using a suction or air pumps to suck the water from the pool into said chambers and then release the stored water to become a wave formation on the surface of their pools. The wave generators are devices built for wave pool use.

All the prior art just described relies upon a water chamber which are vertically connected to the side of a swimming pool. With said chambers connected together and ran the width of said pool. The chambers protrude above the water levels or water surface of their pools. Also the chambers have the presents of air or air pockets in said chambers during operation.

BRIEF DESCRIPTION OF THE INVENTION

The present invention provides a wave generator that can create wave motion in any body of water. The wave cannon can be constructed to be a small cannon built to produce a one foot waveform or a large cannon which could produce a fifteen foot waveform. Wave cannons can be manufactured to produce whatever waveforms desired. The size of the elongated water chambers depends upon the wavelength of the waveforms wanted to artificially create. The wave cannon has the advantage to be placed in any body of water like an ocean, lake, pond, or wave pools. The elongated chambers are totally submerged parallel to the surface of the body of water. With a force of pressurized air entering the back or closed end of the elongated chamber and the water being forced out the open end of the elongated chamber creating a waveform. The elongated chambers are anchored to prevent the movement (recoil) of the elongated chambers during operation. They are anchored to a grade or wedge which is then fastened to the bottom of the body of water or when in deep water the wedge and elongated chambers are lifted up to rest just under the surface of the water. Piping is attached to the back or the closed ends of the elongated chambers. Said piping connects two elongated chambers to an electric activated hydraulic actuated valve. The valve is attached to a pressure tank that stores pressurized air. The pressure tank is pressurized by a means of pressurizing air (air compressors). Multiple air compressors are used one control valve operates two or more elongated chambers.

The volume of air the pressure tank needs to contain has to be equal to or greater than the combined volume of air that the elongated chambers can contain. To widen the width of the waveforms wanted to create the elongated chambers are placed in a row side by side until the desired width is achieved. The valves are electrically connected to operate simultaneously thus actuating stored pressurized air into the elongated chambers forcing the water out of the opened ends of the elongated chambers creating a wave formation. The grade or wedge herein allows the elongated chambers to be refilled with water and allows all of the air that was induced into the elongated chambers to escape out the open ends of the elongated chambers by holding the elongated chambers on an angle to the water surface, with the opened end thereof pointing upwardly therefor reloading the elongated chambers with water allowing for another wave formation sequence. The open end of the elongated chamber face towards the artificial reef, shoreline, or the opposite end of the pool. The elongated chambers are aimed so that when the water is forced out of the elongated chambers it travels across the surface of the body of water in the form of a wave.

Referring to WEBSTER'S II new riverside dictionary, 1984 by Houghton Mifflin Co. states the following definitions that best describe the elongated chambers which are CANNON 1. A weapon consisting of a heavy metal tube mounted on wheels or on a fixed base, used to fire projectiles. WAVELENGTH 1. The distance in a periodic wave between 2 points of corresponding phases.

The definition of the present invention entitled the wave cannon is a wave forming generator consisting of a heavy metal, plastic, Fiberglas, or concrete tubes mounted on a fixed base, used to create wave motion in any body of water. With the length of the elongated chambers being the distance of the wavelength of the waveforms being generated.

Therefor the wave cannon has the flexibility to be placed in any existing bodies of water to create wave motion doing away with the required construction costs of a wave pool. Furthermore the wave cannon can be manufactured in a broad range of sizes with each size variation of the wave cannon producing a different size waveform, giving the wave cannon a broad range of uses and applications.

It is further understood that those skilled in the art will recognize that air and water will fill and take the shape and size of any container. Therefor the shape and size of the elongated water chambers and the air pressure storage tank can be whatever shape or size is applicable or desired. The different shapes and sizes of the elongated water chambers and the air pressure storage tank are within the scope of the present invention.

BRIEF DESCRIPTION OF THE DRAWINGS

FIG: 1 is a schematic top view plan of the present invention.

FIG: 2 is a schematic side view plan of FIG. 1.

Figure 1:
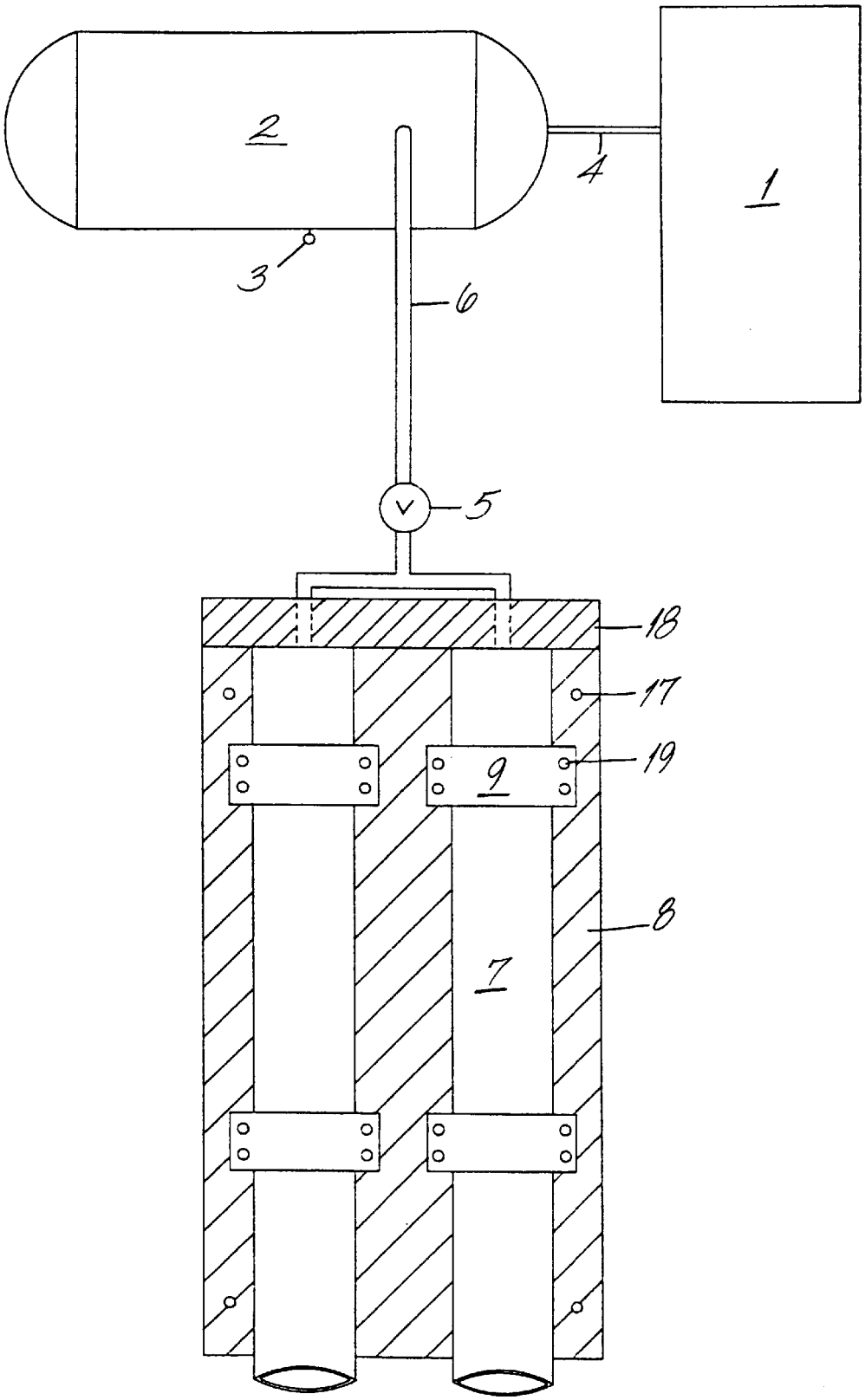

FIG: 3 is a front view plan of FIG. 1.

FIG: 4–7 are components of the present invention.

FIG: 8 is a schematic plan of a wider placement of the elongated chambers than as in FIG. 1

FIG: 9 is a plan side view of the present invention that is placed inside a wave pool.

FIG: 10 is a plan side view of the present invention protruding through the exterior of the wave pool wall.

FIG: 11 is a sequence of side view plans showing one wave formation sequence of the present invention.

FIG: 12 is a schematic top view plan of multiple wave cannons connected together.

FIG: 13 is a schematic top view plan of the present invention placed in a large body of water aiming back at the shoreline.

Figure 13:
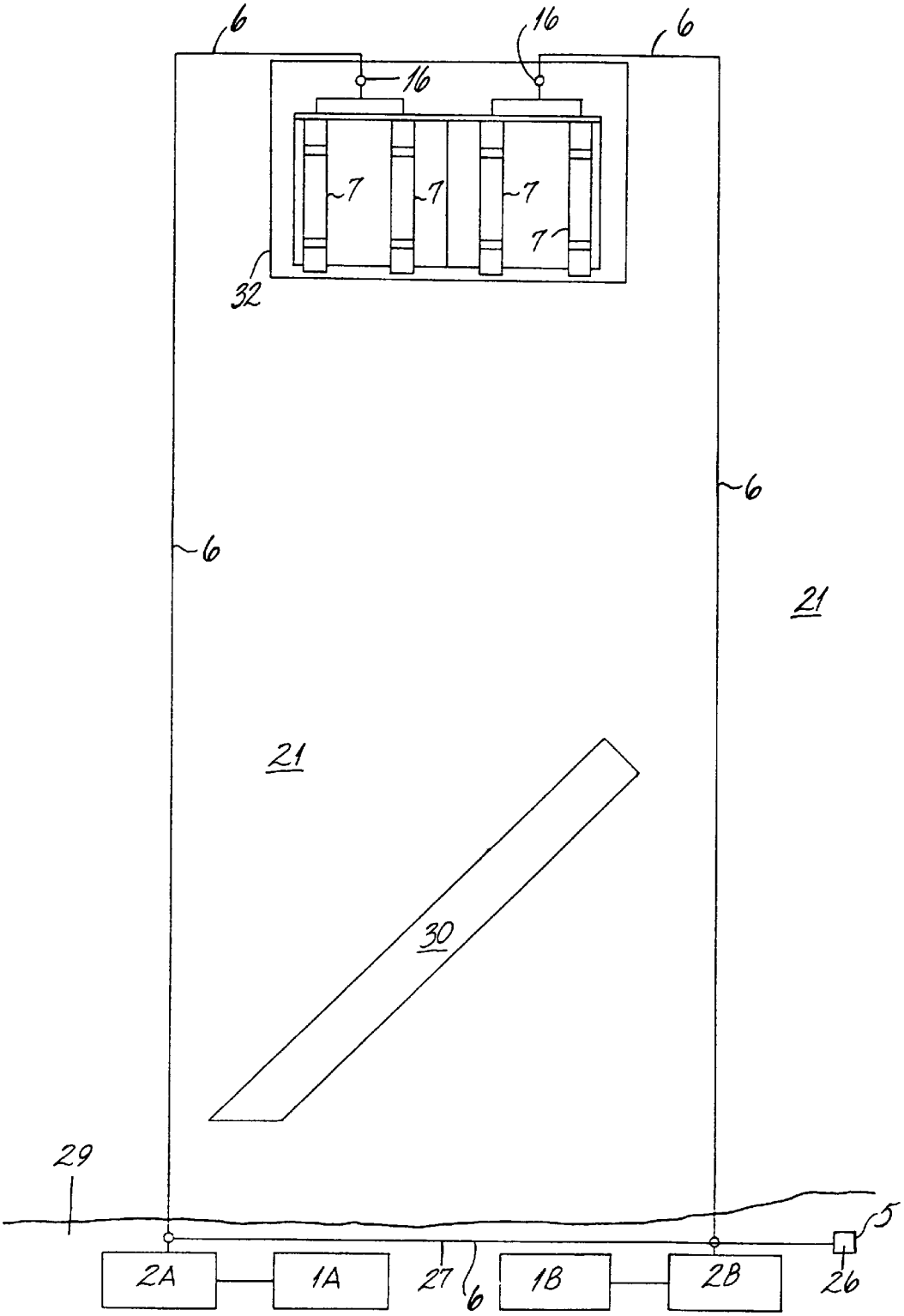

FIG: 14 is a side view plan of FIG. 13.

FIG: 15 is a schematic side view plan of the present invention located off the shoreline of a body of water.

Figure 15:
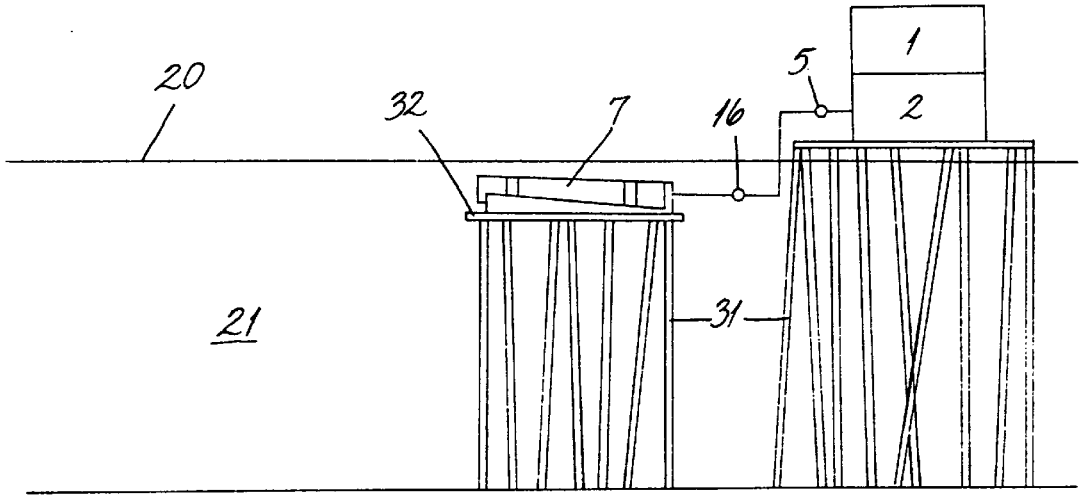

FIG: 16 is a top view plan of FIG. 15

FIG: 17 is a top view plan of a small version of the present invention located in a small body of water.

FIG: 18 is a top view plan of the present invention located in a small pool, fountain.

DRAWING FIGURES

ITEMIZED NUMBER SYSTEM

AIR COMPRESSOR . . . 1
PRESSURE STORAGE TANK . . . 2
PRESSURE GAUGE . . . 3
PIPING @ FITTINGS . . . 4&6
CONTROL VALVE . . . 5
ELONGATED CHAMBERS (WAVE CANNONS) . . . 7
GRADE PLATFORM (THE WEDGE) . . . 8
ANCHORING SYSTEM (CANNON STRAPS) . . . 9
BOTTOM OF THE BODY OF WATER . . . 10
LENGTH OF THE WAVE CANNON . . . 11
HEIGHT OF THE WAVE CANNON . . . 12
NIPPLE ON THE BACK OF THE CANNON . . . 13
NIPPLE ON THE TANK TO ATTACH TO THE COMPRESSOR . . . 14
NIPPLE ON THE TANK TO ATTACH TO THE CONTROL VALVE . . . 15
CHECK VALVE . . . 16
ANCHORING SYSTEM (BOLTS FOR THE WEDGE) . . . 17
BACK WALL ON ANCHORING SYSTEM . . . 18
ANCHORING SYSTEM (BOLTS FOR STRAPS) . . . 19
WATER LEVEL (WATER SURFACE) . . . 20

ITEMIZED NUMBER SYSTEM CONT

BODY OF WATER . . . 21
POOL WALL . . . 22
PRESSURIZED AIR BEING INDUCED INTO THE WAVE CANNONS . . . 23
A WAVE FORM . . . 24
EXHAUSTING AIR . . . 25
SIMULTANEOUS ELECTRIC VALVE ACTIVATOR . . . 26
ELECTRIC WIRE CONNECTING ALL VALVES TOGETHER . . . 27
ARTIFICIAL REEF (DOUBLE BREAK SYSTEM) . . . 28
SHORELINE OF THE BODY OF WATER . . . 29
ARTIFICIAL REEF (SINGLE BREAK) . . . 30
PILES . . . 31
PIER, PILE PLATFORM, DECK . . . 32
POND SHORELINE . . . 33
WAVE MOTION . . . 4

DETAILED DESCRIPTION OF THE DRAWINGS

FIG. 1 is a schematic top view plan of the present invention. The wave generator includes elongated water chambers 7 which are placed on a grade platform 8 . Grade platform 8 is bolted 17 to the bottom of the body of water or grade platform 8 is the formation of the dirt, sand, or soil which could be molded and covered with concrete to take the form and function of grade platform 8. The elongated water chambers 7 are prevented form moving by fastening straps 9 that wrap around the elongated water chambers and bolt 19 into the grade platform 8. The back wall 18 further supports and anchors the elongated water chambers 7. Piping 6 connects the elongated water chambers 7 to a control valve 5 which activates in short sequences. Piping 6 then connects the control valve 5 to a air pressure storage tank 2. The pressure storage tank 2 has a pressure gauge 3 attached to it for reading the amount of air pressure that the air pressure storage tank 2 contains. The air pressure storage tank 2 is connected by piping 4 to a compressor 1 or multitudes of compressors 1 which continuously pressurizes the air pressure storage tank 2 with air.

Figure 2:
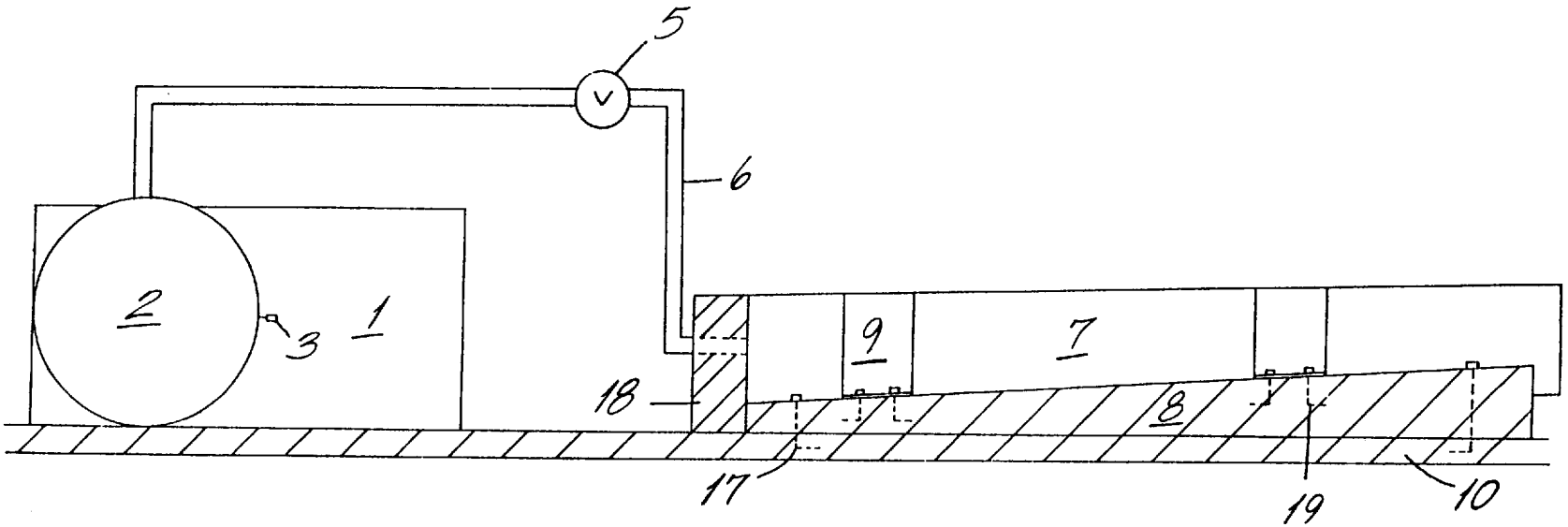

Now referring to FIG. 2 which is a schematic side view plan of FIG 1, with the components having the same numerical reference and function. However it is possible to view the shape of the grade platform 8 and how the fastening straps 9 bolt 19 into the grade platform 8. It also gives us a view of how grade platform 8 bolts 17 into the bottom of the body of water 10. The angle of the grade platform 8 can range between 1 to 10 degrees.

Figure 3:
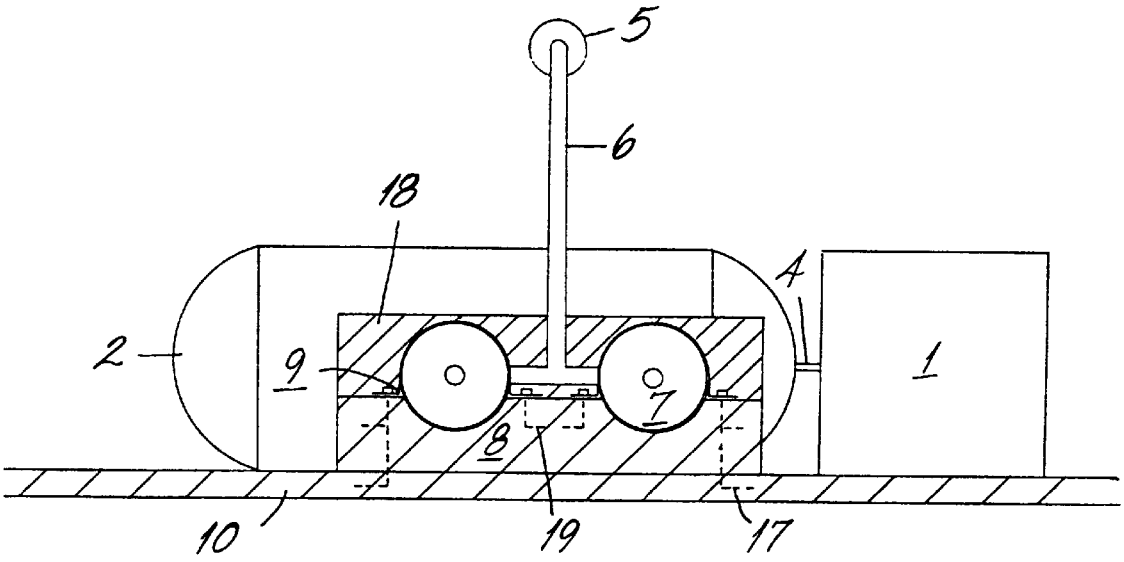

FIG. 3 is a front view plan of the present invention. This view makes it possible to see how the grade platform 8 cradles the elongated water chambers 7.

Figure 4:
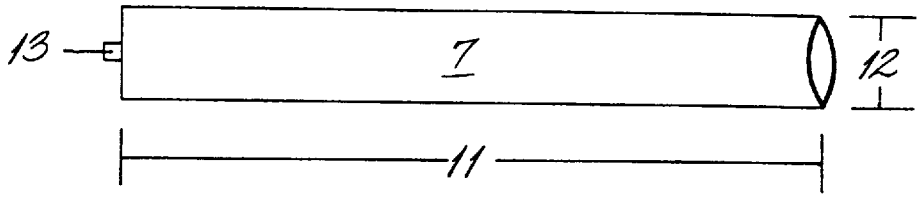

FIG. 4 is the preferred embodiment of a elongated water chamber 7, with having an open end and a closed end. Nipple 13 reduces the size of the back of the elongated water chambers 7 for piping to attach to. Pressurized air is induced into the elongated water chambers 7 through the nipple 13. The height 12 of the elongated chambers 7 needs to equal the height of the wavecrest of the waveforms wanted to artificially create. The preferred length 11 of the elongated water chambers 7 should equal the distance of the wavelength of the waveform wanted to artificially create. But the length 11 can be made smaller or larger to create different variations.

Figure 5:
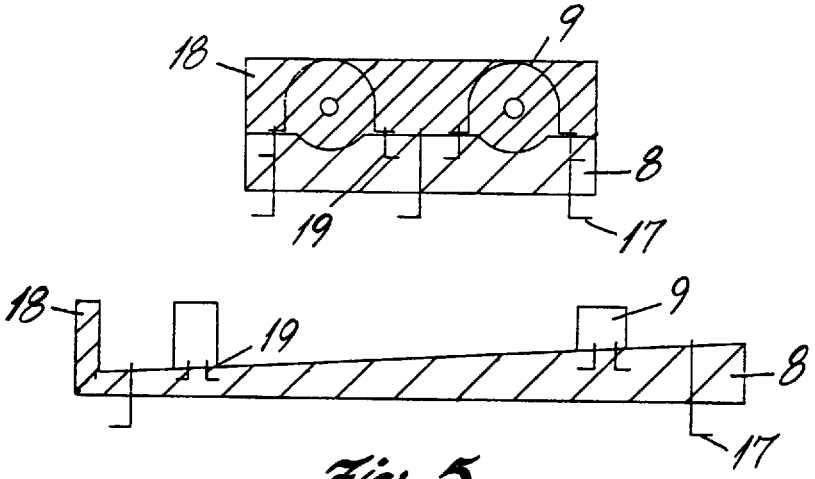

FIG. 5 is a top view and side view plan of the grade platform 8. Which can be molded out of the sand or soil with the anchoring systems bolting 17 & 19 into the soil with having some concrete foundation. The grade platform 8 can also be constructed out of solid concrete.

Figure 6:
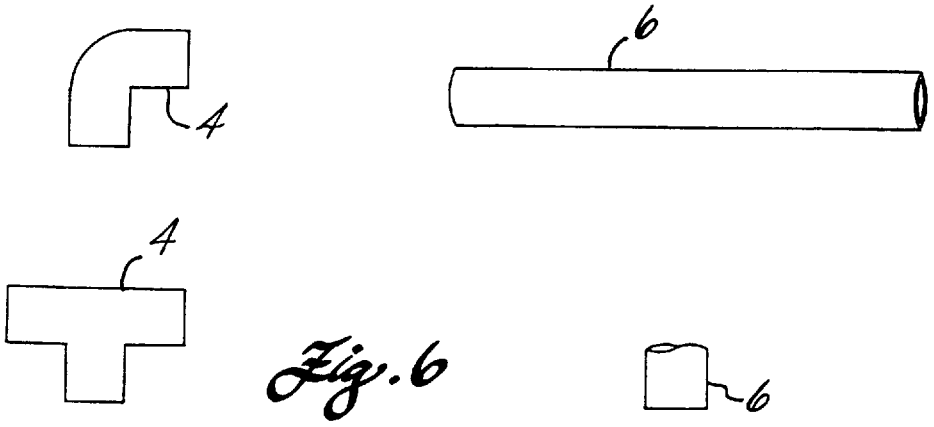

Referring now to FIG. 6, the piping sections and fittings used to connect the components of the present invention together are shown. The piping sections and fittings may be made from a metal or a plastic. However, the piping and fittings must be able to hold 80 psi. of air pressure.

Figure 7:
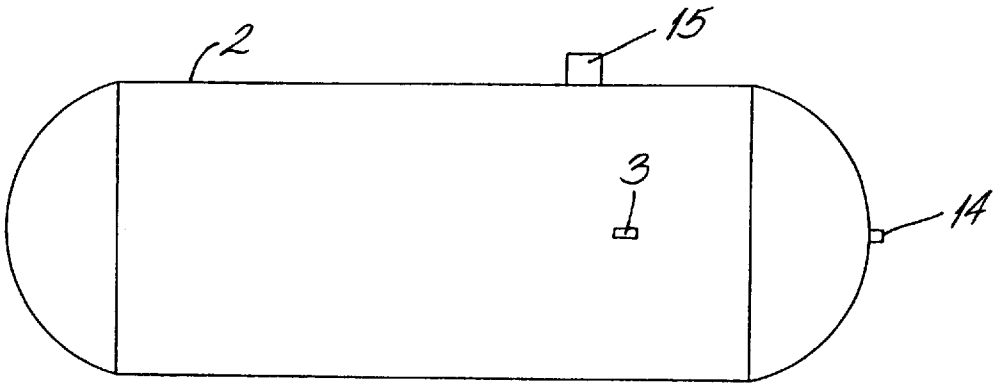

FIG. 7 is a top view of the preferred embodiment of the air pressure storage tank 2 which has a pressure gauge 3 attached to it. Nipple 15 connects to piping that attaches to the control valve 5, as beat illustrated in FIG. 8. Nipple 14 connects to a means of compressed air. The air is induced through nipple 14 into the air pressure storage tank 2.

Figure 8:
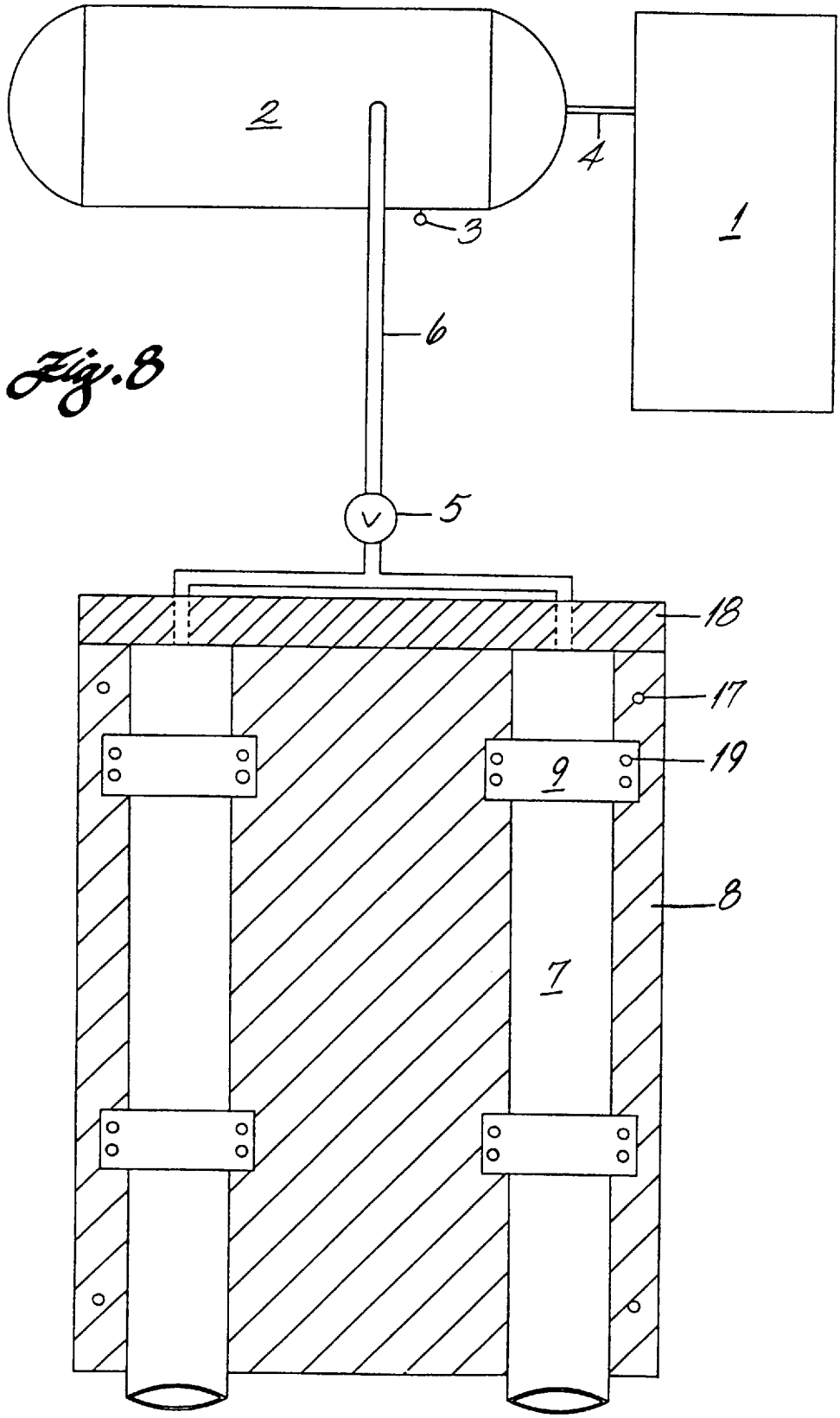

FIG. 8 is an alternate embodiment of FIG. 1, the components have the same numerical reference and function of that in FIG. 1. The difference being the distance that the elongated water chambers 7 are placed apart. Showing that the elongated water chambers have the possibility of being placed and anchored further apart, whatever distances is applicable.

Figure 9:
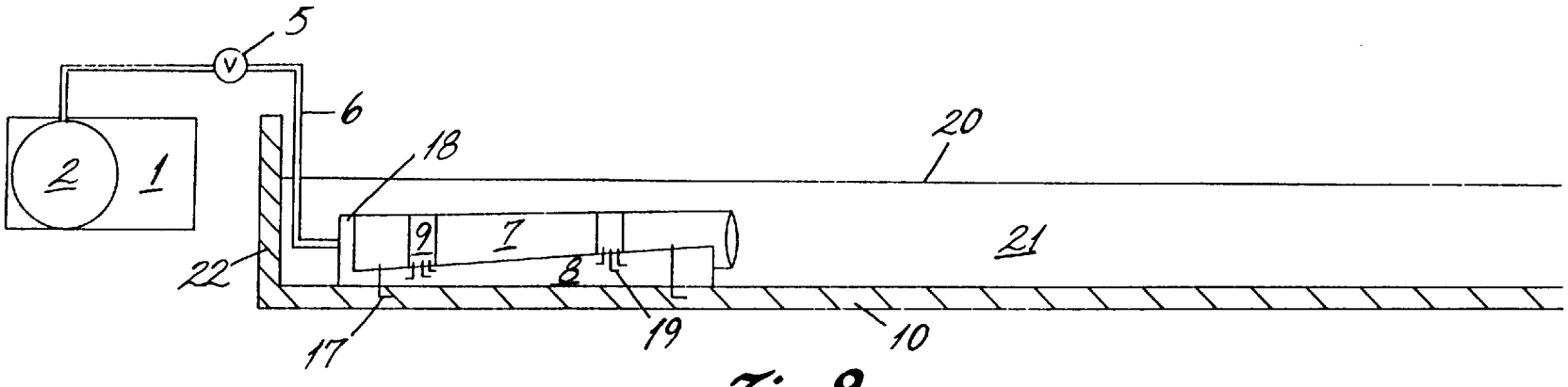

FIG. 9 is a side view plan of the present invention placed inside of a body of water 21. The water surface 20 is above the elongated water chambers 7. FIG. 9 further shows how the control valve 5 is clearly out of the body of water 21. With the air pressure storage tank 2 and the air compressors 1 are behind the pool wall 22 which keeps these items out of the body of water 21. Keeping these items dry there for requiring less maintenance.

Figure 10:
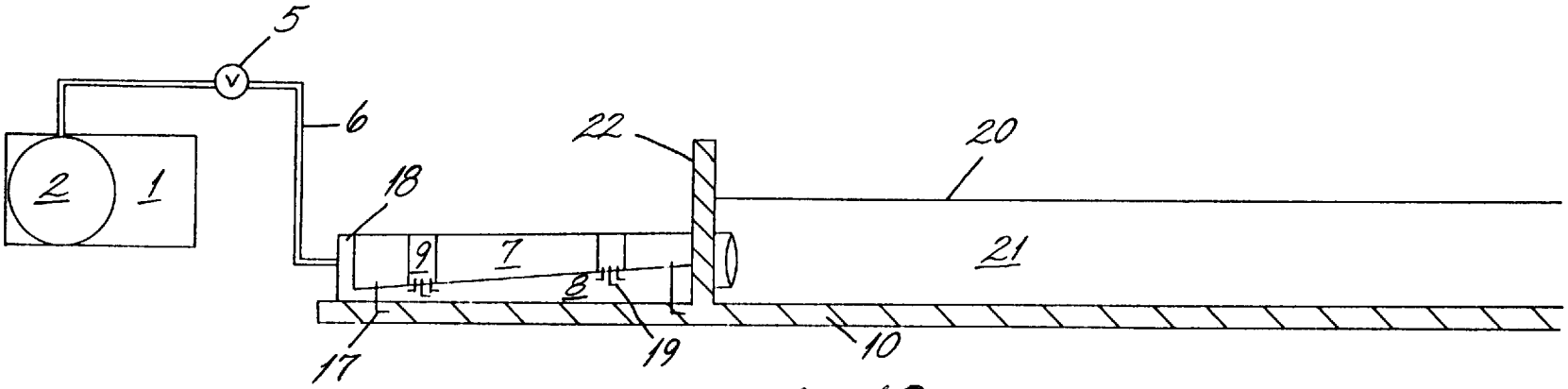

FIG. 10 is a side view plan of the present invention attached to a body of water 21. By the elongated water chambers 7 going through the pool wall 22 keeping the open ends of the elongated water chambers 7 below the water surface 20.

Figures 11A, 11B, 11C:
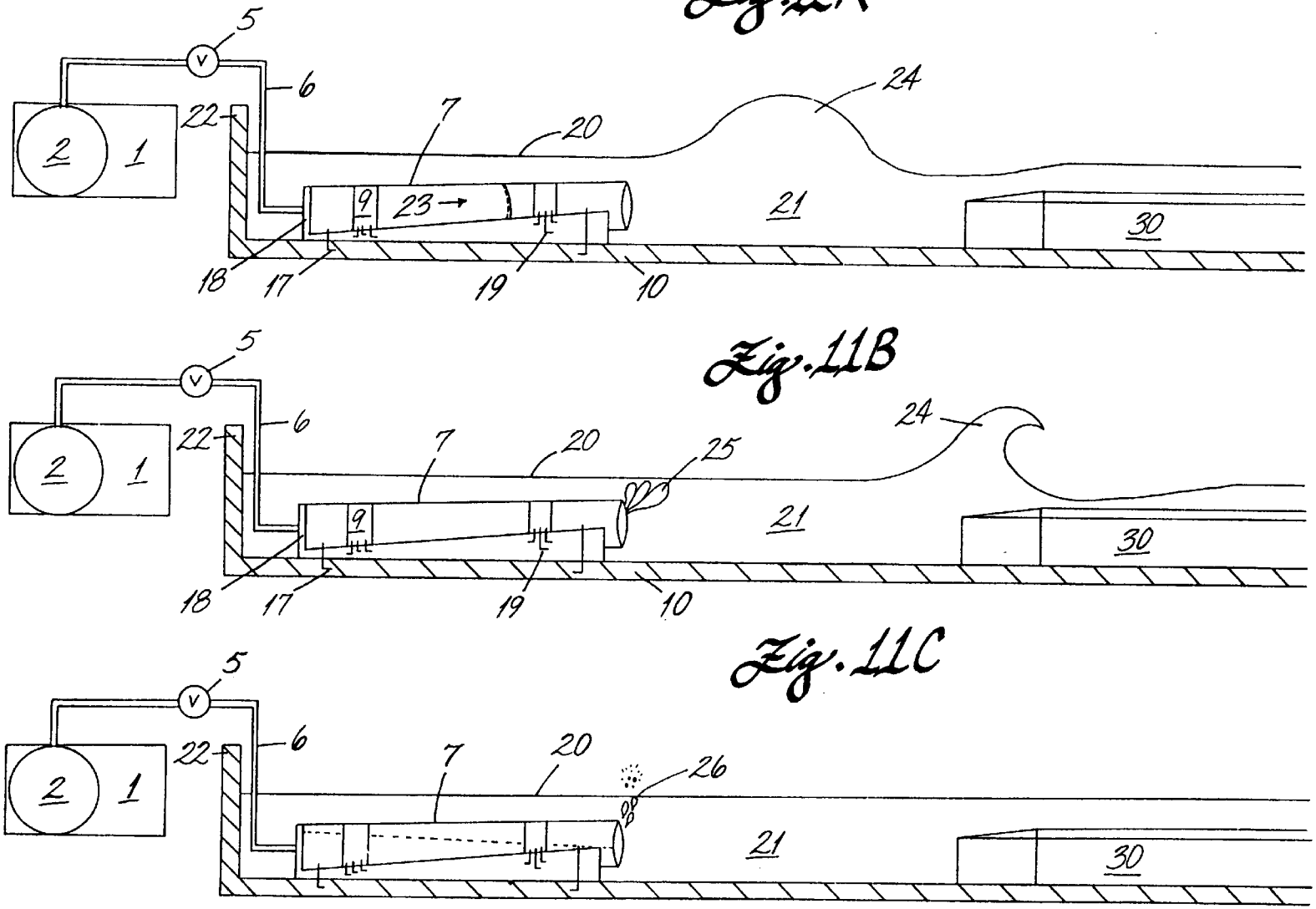

FIG. 11 is a sequence of side view plans showing one wave formation sequence of the present invention. Reference numeral 23 denotes the air that is being induced through pipe 6 into the elongated water chamber 7 forcing the water that they contained out into the body of water 21 creating a wave form 24. An artificial reef 30 controls the breaking direction of the wave form 24. Number 25 being the air that was induced, escaping out of the open ends of the elongated water chambers 7 therefor re-loading the elongated water chamber 7 with water preparing for another wave formation sequence.

Figure 12:
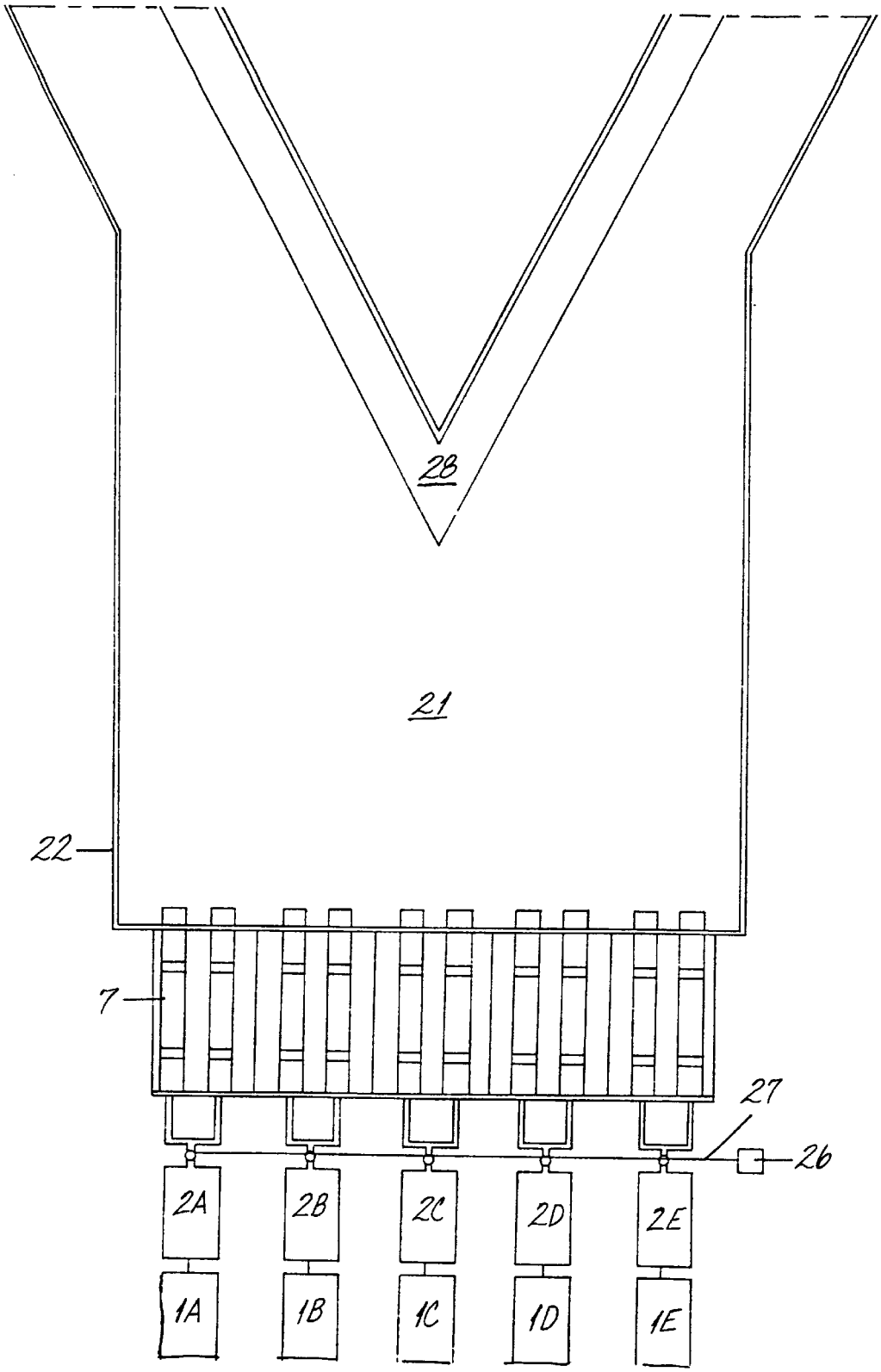

FIG. 12 is a preferred embodiment of a schematic top view plan of multiple wave cannons connected to a wave pool. The present invention is connected together until the desired width you wish the waveform being created to be is achieved. The multitude of control valves 5 are electrically connected 27 to a electric valve activator 26 which activates all of the control valves 5 simultaneously in short interval sequences. The elongated water chambers 7 protrude through the pool wall 22 to connect with the body of water 21. After the electric valve activator 26 activates a waveform travels from the open ends of the elongated water chambers 7 to the artificial reef 28 said artificial reef 28 makes the waveform plunge and peel.

FIG. 13 is a schematic top view plan of the present invention placed in a large body of water 21 aiming back at the shoreline 29. The air compressors 1*a* @ 1*b*, air pressure storage tank 2*a* @ 2*b* along with the control valves 5 and the valve activator 26 are on the shoreline 29 keeping these components dry and them requiring less maintenance. Piping 6 runs out on the bottom of the body of water 21 to connect to valves 16. The check valve 16 keep the water 21 from entering the piping 6. The check valves 16 are piped 6 to multiple elongated water chambers 7. The elongated water chambers 7 are anchored on the pile platform 32. Said elongated water chambers 7 are aimed so that the waveform travels to an artificial reef 30 which makes the waveform plunge and peel.

Figure 14:
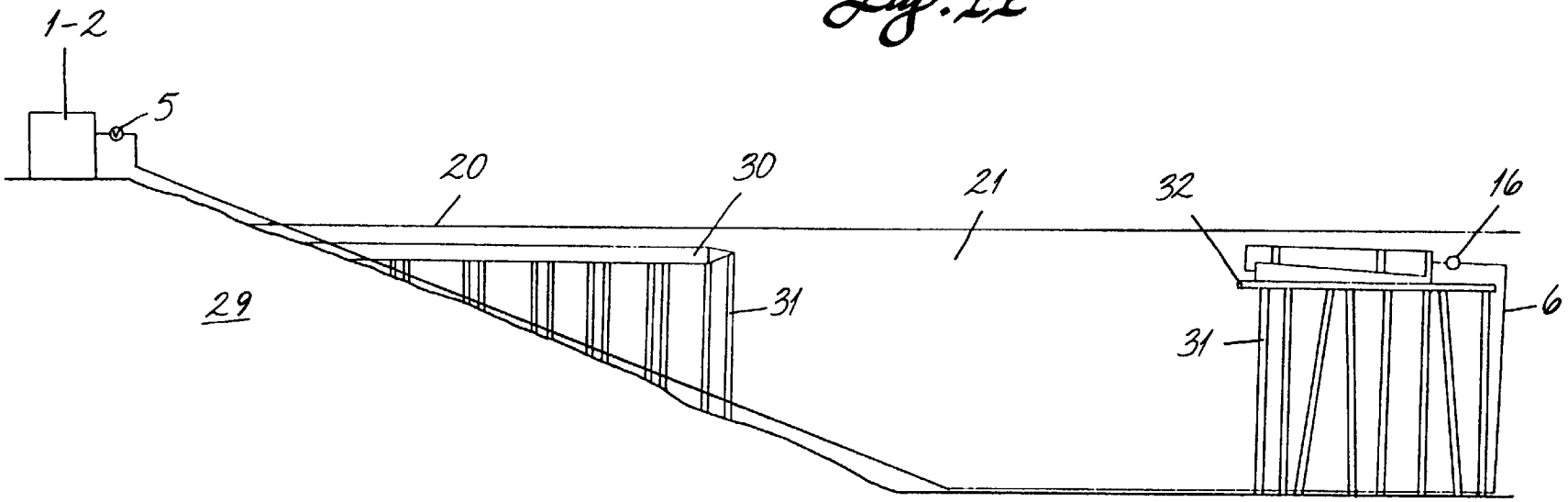

FIG. 14 is a side view plan of FIG. 13 with the components of the present invention in the same arrangement and position as that in FIG. 13 also the components have the same numerical number.

In FIG. 14 it is possible to view how the grade platform 8 and the elongated water chambers 7 are lifted up off the bottom with piles 31 which holds the elongated water chambers 7 just below the surface of the water 20. In places where you cannot form a reef with the materials present at the location where you are going to create a waveform a artificial reef 30 can be used.

FIG. 15 is a schematic side view plan of the present invention located off the shoreline of a body of water 21 with the grade 8 and the elongated water chambers 7 anchored onto the pile platform 32 which is lifted up off the bottom of the body of water 21. Piles 31 lift the control valve 5, air compressors 1 and the air pressure storage tank 2 out of the body of water 21. Keeping these components dry is important for less maintenance requirement. The elongated water chambers 7 are placed to be just below the water surface 20.

Figure 16:
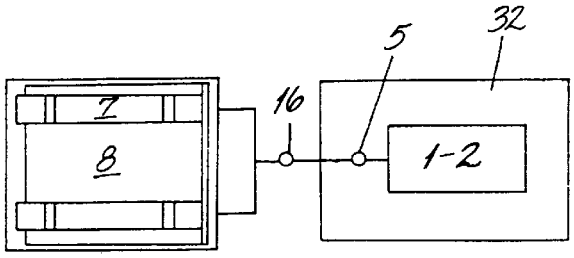

FIG. 16 is a top view plan of FIG. 15 with the components of the present invention in the arrangement and position as that in FIG. 15. This embodiment of the present invention can be used to fight erosion of are coastlines by creating artificial waves to calm or even cancel out natural storm surf. Therefor stopping the storm surf and surge from ever reaching the coastlines.

Figure 17:
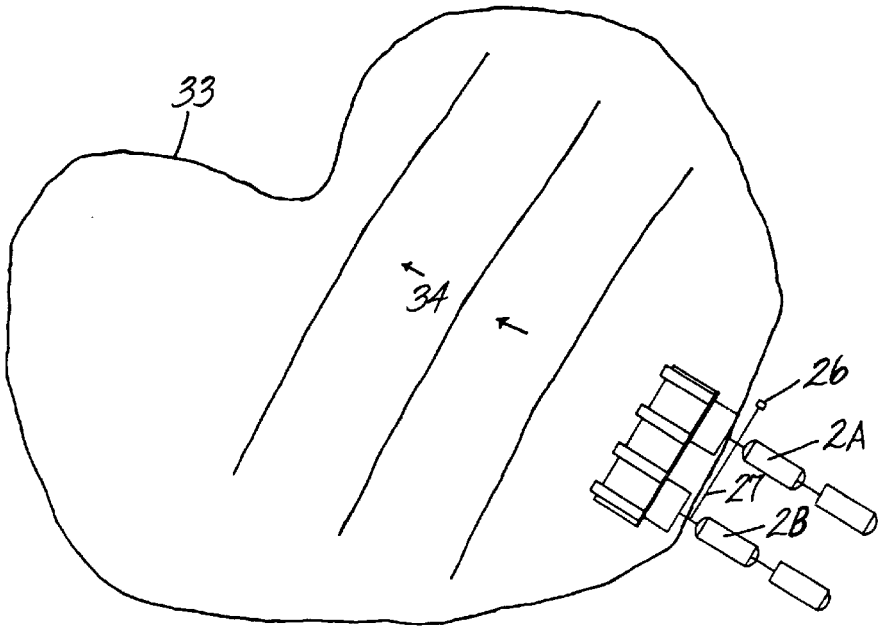
Figure 18:
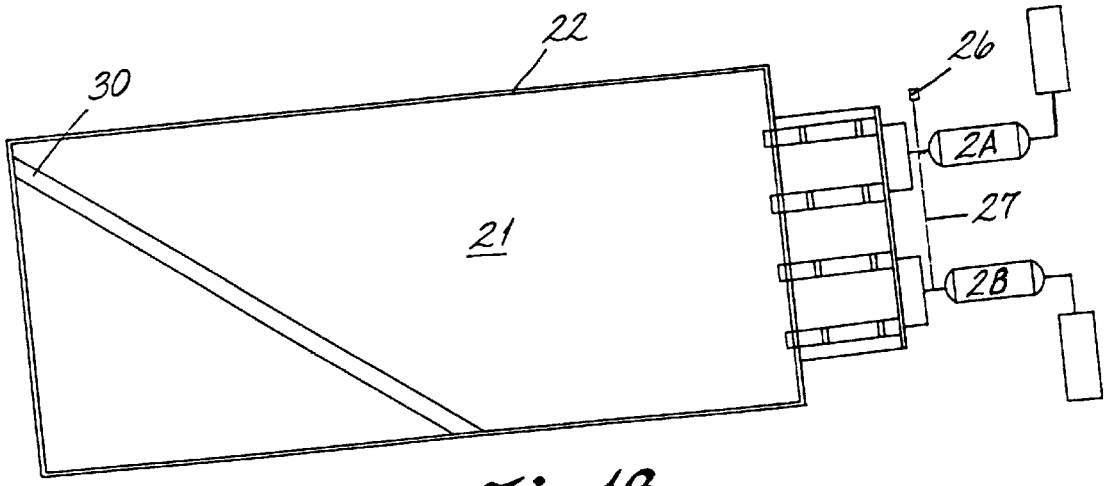

Referring now to FIGS. 17 and 18, the wave generating device of the present invention is shown in a small pond and a small pool respectively. The use of this application of the present invention would be for visual and acoustic entertainment.

In FIG. 17 a small pond was formed and the elongated water ambers 7 are placed inside of the pond. The control valve activates creating wave motion 34 which breaks on the pond shoreline 33. In FIG. 18 the present invention is placed inside small pool to create wave motion.

The terms and definitions for the above descriptions, as well as modifications and changes or substitutions for various system components will be recognized by those skilled in the art to be within the scope of the present invention, which is not to be limited only by the claims which follow.

What is claimed is:

1. A wave generating device for generating wave motion in a body of water, said wave generating device comprising:

an elongated tubular chamber having a substantially a closed rear end and an open front end;

an anchor securing the entire tubular chamber below a surface of the body of water and for maintaining the tubular chamber substantially parallel to the surface of the body of water;

a supply of compressed air fluidly interconnected with the tubular chamber; and a control valve in fluid communication with the supply of compressed air for operatively controlling the flow of compressed air into the tubular chamber, wherein actuation of the control valve releases the compressed air into the rear end of the tubular chamber to forcibly expel the water out of the open front end and generate a wave in the body of water.

2. The wave generating device as recited in claim 1 wherein the supply of compressed air comprises a compressed air tank fluidly connected with an air compressor.

3. The wave generating device as recited in claim 2 wherein the compressed air tank has a volume at least equal to the volume of the tubular chamber.

4. The wave generating device as recited in claim 1 wherein the anchor comprises a plurality of anchors, each being driven into a bottom surface of the body of water and attached to the tubular chamber.

5. The wave generating device as recited in claim 1 wherein the anchor comprises an angled grade platform.

6. The wave generating device as recited in claim 5 wherein the tubular chamber is attached to the grade platform such that the front end is elevated relative to the rear end.

7. A pneumatic wave generating device for generating a wave having a wave crest height and a wavelength in a body of water having an exposed surface, said wave generating device comprising:

an elongated tubular chamber having between a closed rear end and an open front end;

an anchor attached to the elongated chamber and secured relative to the body of water for securing the elongated chamber and maintaining the elongated chamber below and substantially parallel to the surface of the body of water;

an air compressor;

a compressed air storage tank fluidly connected with the rear end of the elongated chamber and the air compressor; and a control valve mounted between the compressed air storage tank and the elongated chamber for operatively controlling the flow of compressed air into the elongated chamber, wherein actuation of the control valve releases compressed air into the rear end of the elongated chamber to forcibly expel the water out of the open front end and create a wave within the body of water.

8. The pneumatic wave generating device as recited in claim 7, and further comprising a plurality of elongated tubular chambers, each being interconnected with a control valve and a supply of compressed air.

9. The pneumatic wave generating device as recited in claim 8, and further comprising a plurality of piping members interconnecting the compressed air tank to the control valve and the control valve to each of the plurality of elongated chambers.

10. The pneumatic wave generating device as recited in claim 8 wherein the volume of the compressed air tank is less than volume of the plurality of elongated chambers.

11. The pneumatic wave generating device as recited in claim 7 wherein the distance between the rear end and the front end of the elongated chamber is substantially equal to the wavelength of the generated wave.

12. The pneumatic wave generating device as recited in claim 7 wherein the open front end comprises an opening height substantially equal to the generated wave crest height.

13. The pneumatic wave generating device as recited in claim 7, and further comprising a plurality of piping members interconnecting the compressed air tank to the control valve and the control valve to a nipple fluidly interconnected to the rear end of the elongated chamber.

14. The pneumatic wave generating device as recited in claim 7 wherein the elongated chamber comprises a metal pipe.

15. A method of generating a wave in a body of water, said method comprising the steps of:

providing a wave generating device including an elongated tubular chamber having a substantially closed rear end and an open front end, the closed rear end being fluidly interconnected with a supply of compressed air and a control valve;

anchoring the entire elongated chamber submerged below the surface of the body of water such that the open end is maintained slightly elevated relative to the closed rear end;

filling the elongated chamber with water; and opening the control valve to release the compressed air into the rear end of the chamber and thereby force the filled water out of the elongated chamber and into the body of water to form a wave.

16. The method as recited in claim 15, and further comprising the step of closing the control valve to stop the flow of compressed air into the elongated chamber.

17. The method as recited in claim 16 wherein the step of filling the elongated chamber comprises allowing the elongated chamber to gravity fill with water.

18. The method as recited in claim 17 wherein the steps of filling the elongated chamber and opening and closing the control valve are repeated to form a plurality of waves in the body of water.

19. The method as recited in claim 18 wherein the steps of filling the elongated chamber and opening and closing the control valve are done in rapid succession to form a plurality of closely spaced waves in the body of water.

20. The method as recited in claim 15, and further comprising the step of providing an artificial reef within the body of water for shaping the generated wave.

* * * * *